United States Patent [19]

Nishizawa et al.

[11] Patent Number: 4,715,792

[45] Date of Patent: Dec. 29, 1987

[54] VARIABLE CAPACITY VANE TYPE COMPRESSOR

[75] Inventors: Kazutoshi Nishizawa, Toyoake; Masashi Takagi, Kariya; Akio Matsuoka, Obu, all of Japan

[73] Assignee: Nippondenso Co., Ltd., Kariya, Japan

[21] Appl. No.: 848,230

[22] Filed: Apr. 4, 1986

[30] Foreign Application Priority Data

Apr. 5, 1985 [JP] Japan ..... 60-51376[U]

[51] Int. Cl.[4] ..... F04B 49/00

[52] U.S. Cl. ..... 417/295; 417/302; 417/310

[58] Field of Search ..... 417/295, 302, 304, 310

[56] References Cited

U.S. PATENT DOCUMENTS 4,557,670 12/1985 Inagaki et al. ..... 417/310

FOREIGN PATENT DOCUMENTS 48212 12/1982 Japan ..... 417/310

48405 5/1984 Japan ..... 417/310

59-162387 9/1984 Japan .

48510 10/1985 Japan ..... 417/310

*Primary Examiner*—William L. Freeh

*Attorney, Agent, or Firm*—Cushman, Darby & Cushman

[57] ABSTRACT

A variable capacity vane type compressor has an unloading mechanism operative to relieve a part of compressed fluid from a working chamber when in its compression stroke and an additional mechanism for controlling the suction of fluid into the compressor. The additional mechanism has a spool valve movable to a position to restrict the opening area of the compressor suction port. The spool valve is disposed in a passage communicated with the suction port and with a working chamber when in its compression stroke. The spool valve is formed therein with another passage which, when the spool valve is in the position to restrict the suction port, communicates the compression chamber with the suction port to relieve a part of the compressed fluid.

8 Claims, 12 Drawing Figures

VARIABLE CAPACITY VANE TYPE COMPRESSOR

BACKGROUND OF THE INVENTION

The present invention relates to a variable capacity vane type compressor which is suitable for use as a refrigerant compressor of an automotive air conditioner.

DESCRIPTION OF THE PRIOR ART

In a known variable capacity vane type compressor, the control of the discharge rate or capacity is conducted by opening a bypass passage between a compression chamber and a low pressure chamber, i.e., a suction chamber. This known variable capacity vane type compressor, however, encounters a problem that, in the case where it is driven by an engine, a desired control of the displacement capacity cannot be attained when the speed of the compressor is increased in accordance with an acceleration of the engine. More specifically, during high speed operation of the compressor, a required rate of relief of the compressed fluid from the compression chamber into the suction chamber is not achieved, with a result that the discharge rate or capacity of the compressor cannot be reduced to a required level.

In order to obviate this problem, a compressor has been proposed in, for example, Japanese Patent Unexamined Publication No. 162387/1984, in which an unloading mechanism for selectively relieving fluid from a compression chamber to a suction side is combined with a suction restriction mechanism which is adapted to restrict a suction port or a suction passage to reduce the rate of suction of the fluid when the unloading mechanism is operating.

This type of capacity controller, however, is still unsatisfactory in that it cannot provide a required rate of relief of the fluid from the compression chamber particularly when the compressor speed is very high or when there is a demand for a further reduction in the capacity.

SUMMARY OF THE INVENTION

The present invention provides a variable capacity vane type compressor which comprises a housing providing a cylinder of a predetermined profile having ends closed by end walls. A rotor is disposed in the cylinder and rotatable by an external power. The rotor is formed therein with a plurality of vane grooves in which vanes are slidably received and have outer ends disposed in slidable engagement with the inner surface of the cylinder to cooperate therewith and with the end walls to define a plurality of variable volume working chambers. A suction port is so disposed as to be open to one of the working chambers when it is in its suction stroke. An unloading mechanism is provided and includes a first unloading port and a first unloading passage. The unloading mechanism is arranged such that the unloading port is open to one of the working chambers when in its compression stroke and to relieve therefrom compressed fluid through the first unloading passage to a lower pressure part of the compressor. A discharge port is so disposed as to be open to one of the working chambers when it is in its final stage of the compression stroke. The unloading mechanism furthe includes a first valve member for varying the opening area of the unloading port. The suction of fluid into the compressor is controlled by a second valve member movable in a second passage to vary the opening area of the suction port. The second passage has first and second portions communicated, respectively, with the suction port and one of the working chambers when it is in its compression stroke. The first and second valve members have pressure receiving faces, respectively, and are movable by the same pressure signal applied to the pressure receiving faces. The second valve member is formed therein with a third communication passage which, when the second valve member is in a position in which the opening area of the suction port is decreased most, communicates the suction port through the first and second portions of the second passage with one of the working cambers when in the compression stroke.

By the above feature of the invention, the compressor can be reliably unloaded to assure a highly economical compressor operation.

The above and other objects, features and advantages of the invention will be made more apparent by the following description of the preferred embodiment with reference to the accompanying drawings.

DESCRIPTION OF THE PREFERRED EMBODIMENT

A preferred embodiment of the invention will be described hereinunder with reference to the drawings.

Figures 1, 1A:
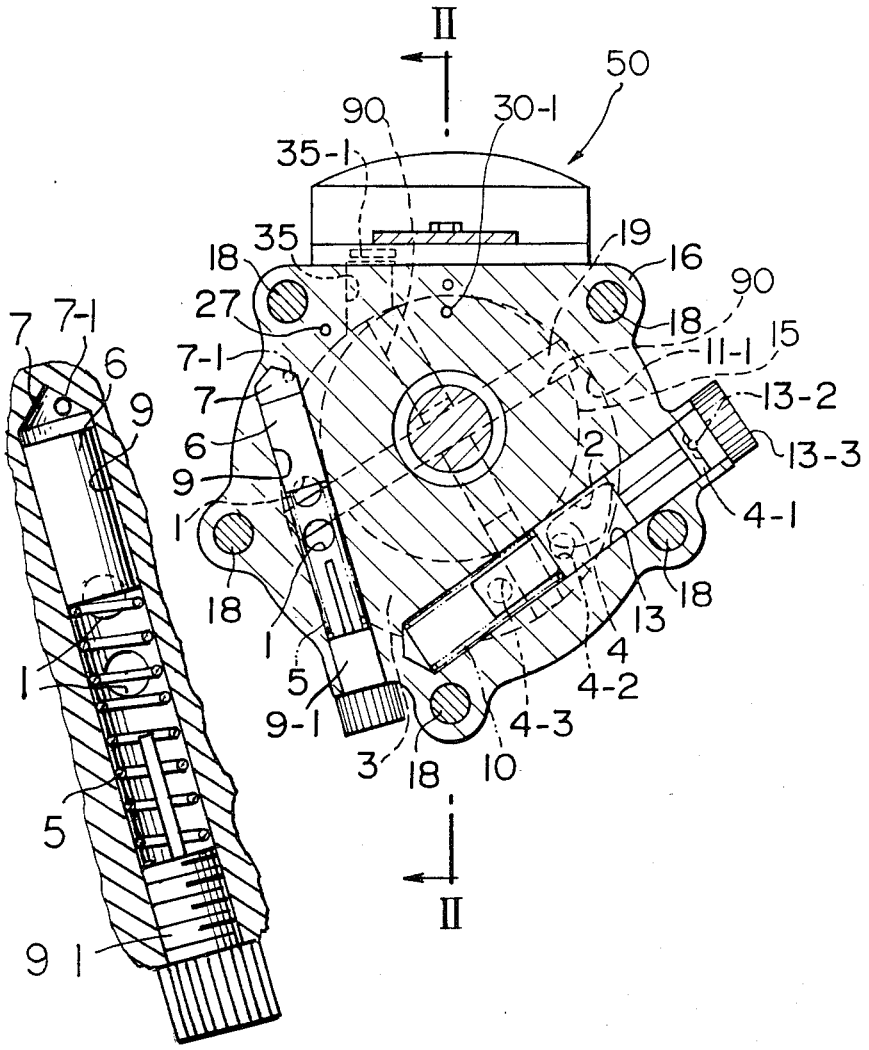
FIG. 1 is a cross-sectional view of an embodiment of variable capacity vane type compressor according to the invention, taken along line I—I in FIG. 2.
FIG. 1A is an enlarged fragmentary view of a portion of FIG. 1.
Figure 2:
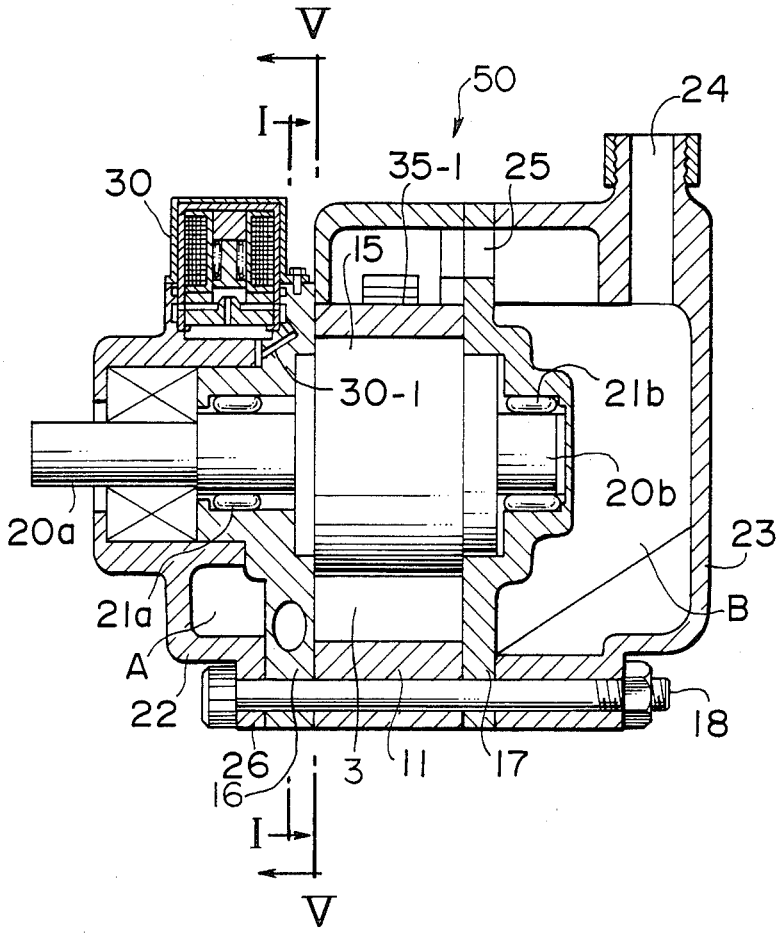
FIG. 2 is a sectional view taken along line II—II in FIG. 1.

Referring to FIGS. 1 and 2, a compressor 50 embodying the present invention has a main housing member 11 which defines the outer configuration of the compressor. A cylinder 11-1 having a special profile is formed in the housing member 11. A rotor 15 is disposed in the cylinder 11-1 and has an axis which is offset from the axis of the cylinder 11-1. A front end plate 16 is secured to the front end surface of the cylinder 11-1, while a rear end plate 17 is secured to the rear end surface of the cylinder 11-1. A pair of vane grooves 90, which are orthogonal to each other, are formed in the rotor 15 and extend through the center of the rotor 15. These vane grooves slidably receive vanes 19. Working or compression chambers 3 are defined by the cooperation of the vanes 19, the inner surface of the cylinder 11-1 and the inner surfaces of the front and rear end plates 16 and 17. The vanes 19 and the rotor 15 may have the same shapes as those disclosed in Japanese Utility Model Unexamined Publication No. 152486/1982. A front shaft 20*a* is formed integrally with the front end surface of the rotor 15, while a rear shaft 20*b* is fixed to the rear end surface of the rotor 15 by means of bolts, not shown.

The front shaft 20*a* is rotatably supported by the front end plate 16 through a bearing 21*a*, while the rear shaft 20*b* is supported by the rear end plate 17 through a bearing 21*b*. A front housing member 22 having a peripheral flange 26 is provided on the front side of the front end plate 16, while a rear housing member 23 is provided on the rear side of the rear end plate 17. The front housing member 22, front plate 16, main housing member 11, rear end plate 17 and rear housing member 23 are assembled and tightened together by means of tie bolts 18.

A suction chamber A is defined between the front end plate 16 and the front housing member 22, while a discharge chamber B, which also acts as an oil separation chamber, is defined between the rear end plate 17 and the rear housing member 23. The rear end plate 17 is formed therein with a discharge port 24 through which the refrigerant discharged into the discharge chamber B is delivered to a condenser of a refrigeration cycle. The main housing member 11 is provided with a discharge hole 25 through which the refrigerant compressed in the compression chamber 3 is discharged into the discharge chamber B.

Referring specifically to FIG. 1, unloading ports 1 are formed in the front end plate 16 in such positions that these unloading ports 1 are opened to the compression chamber 3 when in a stage in which the volume of the compression chamber 3 is being decreased, so as to allow this compression chamber 3 to communicate with the suction chamber A. The front end plate 16 is further provided with a first plunger bore 9 which orthogonally crosses the unloading ports 1. A first spool valve in the form of a plunger 6 is slidably received in the plunger bore 9 so that the unloading ports 1 are opened and closed as the plunger 6 slides in the bore 9. The open end of the plunger bore 9 is closed by a plug 9-1 screwed into this end of the bore 9. A spring 5 is interposed between the plug 9-1 and one end of the first plunger 6. A first plunger chamber 7 is defined between the other end of the first plunger 6 and the adjacent end of the bore 9. The position of the first plunger 6 and, therefore, the opening area of the unload ports 1 can be determined dependent upon the force of the spring 5 and the pressure in the first plunger chamber 7. As will be explained later, the pressure in the first plunger chamber 7 is controlled by means of a solenoid valve 30.

The refrigerant in the suction chamber A is introduced into the compression chamber 3 through a suction port 2 formed in the front end plate 16. The suction port 2 is located such that it opens to the compression chamber 3 when in a stage in which the volume of the compression chamber 3 is being increased. A second plunger bore 13 is formed in the front end plate 16 substantially orthogonally to the direction of the opening of the suction port 2 to the bore 13. This second plunger bore 13 slidably receives a second spool valve in the form of a plunger 4. The open end of the second plunger bore 13 is closed by a plug 13-3 screwed into this open end. A spring 10 is disposed so as to act between the bottom of the second plunger bore 13 and the second plunger 4. A second plunger chamber 13-1 (see FIG. 3) is defined between the second plunger 4 and the plug 13-3.

A discharge port 35 for discharging the refrigerant from the compression chamber 3 into the discharge chamber B is formed in the peripheral wall of the cylinder 11-1 at a point where the volume of the compression chamber 3 becomes minimum. A discharge valve 35-1 is provided for this discharge port 35.

Figure 4:
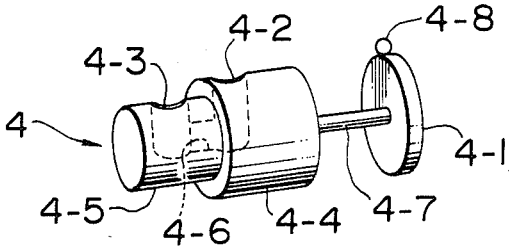
FIG. 4 is a perspective view of the second plunger.

As will be seen in FIG. 4, the second plunger 4 has a disc portion 4-1, a large-diameter portion 4-4, a small-diameter portion 4-5 and a rod portion 4-7 which interconnects the disc portion 4-1 and the large-diameter portion 4-4. The disc portion 4-1, the rod portion 4-7 and the large-diameter portion 4-4 are formed integrally with each other, while the small-diameter portion 4-5 is forcibly driven into a hole in the large-diameter portion 4-4 and fixed thereto. A communication passage 4-6 is formed in the small-diameter portion 4-5 and in the large-diameter portion 4-4. The communication passage 4-6 opens at its one end in the peripheral surface of the large-diameter portion 4-4 as at 4-2 and at its other end in the peripheral surface of the small-diameter portion as at 4-3. A projection 4-8 is formed on the outer peripheral surface of the disc portion 4-1 and received in a U-shaped groove (not shown) formed in the inner peripheral surface of the second plunger bore 13 so as to prevent the second plunger 4 from rotating about its own axis.

Figure 5:
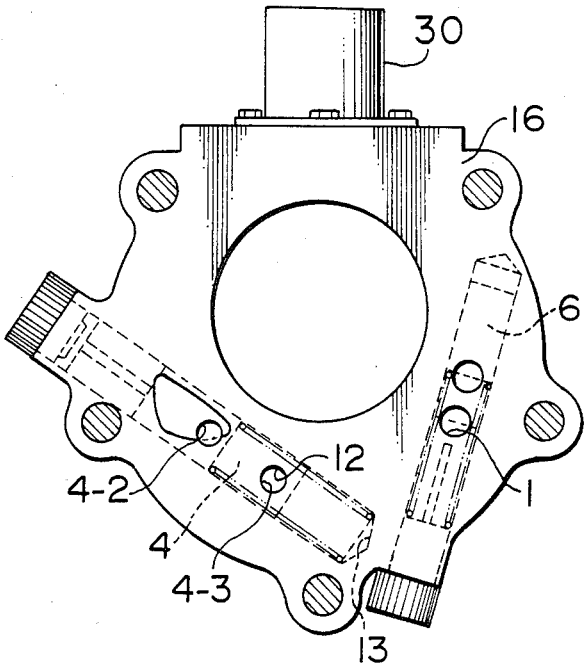
FIG. 5 is a sectional view taken along the line V—V in FIG. 2.

Referring to FIG. 5, the second plunger bore 13 is communicated with the cylinder 11-1 through a communication hole 12 formed in the front end plate 16 at a point which leads the suction port 2 as viewed in the direction of rotation of the rotor 15.

Figure 3A:
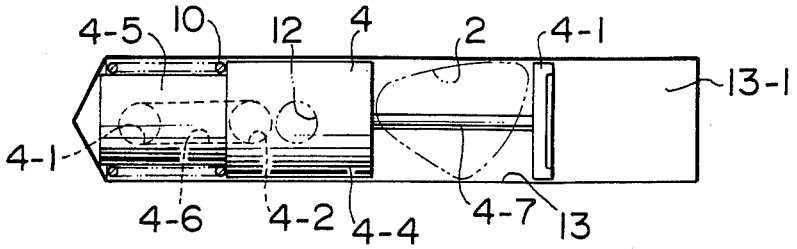
FIGS. 3A and 3B diagrammatically illustrate the positional relationship between a second plunger and a suction port.
Figure 3B:
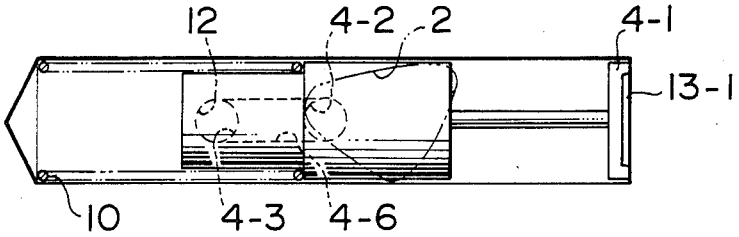

FIGS. 3A and 3B show the positional relationship between the second plunger 13 and the suction port 2. More specifically, in the state shown in FIG. 3A, the suction port 2 is fully opened because the second plunger 4 has been moved leftward such that the large-diameter portion 4-4 clears the suction port 2. On the other hand, when the second plunger 4 is in the position shown in FIG. 3B, the large-diameter portion 4-4 of the second plunger 4 is aligned with the suction port 2 to minimize the opening area of the suction port 2. When the second plunger 4 is in the position shown in FIG. 3B, the communication hole 12 is aligned and communicated with the end 4-3 of the communication passage 4-6. The spring 10 mentioned before has its one end disposed in contact with the bottom of the second plunger bore 13. The other end of the spring 10 engages a shoulder defined between the large-diameter portion 4-4 of the second plunger 4 and the small-diameter portion 4-5 thereof. Thus, the position of the second plunger 4 is determined dependent on the force of the spring 10 and the pressure in the second plunger chamber 13-1.

Figure 6:
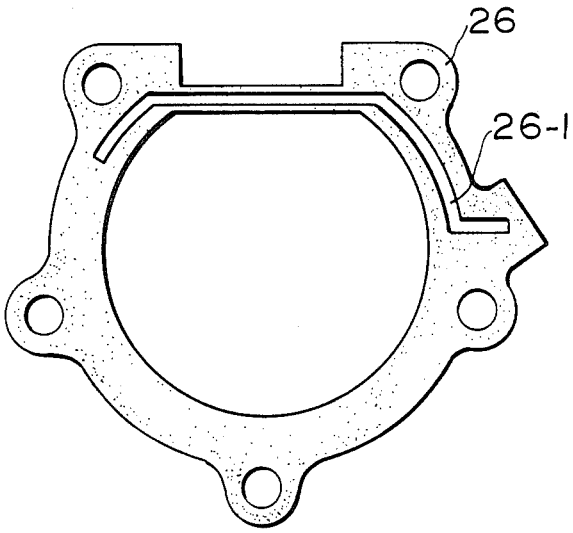
FIG. 6 is a plan view of a gasket.

FIG. 6 shows a gasket 26 which is placed between the front end plate 16 and the front housing member 22. This gasket 26 has a communication passage formed by an elongated arcuate slit 26-1 which provides communication between a first small hole 7-1, a second small hole 27, a third small hole 30-1 and a fourth small hole 13-2 to be described below. The first small hole 7-1 opens to the first plunger chamber 7, while the second small hole 27 opens to a portion of the compression chamber 3 near the discharge port 35. On the other hand, the third small hole 30-1 opens to the inlet port of the solenoid valve 30, while the fourth small hole 13-2 opens to the second plunger chamber 13-1.

Figure 7:
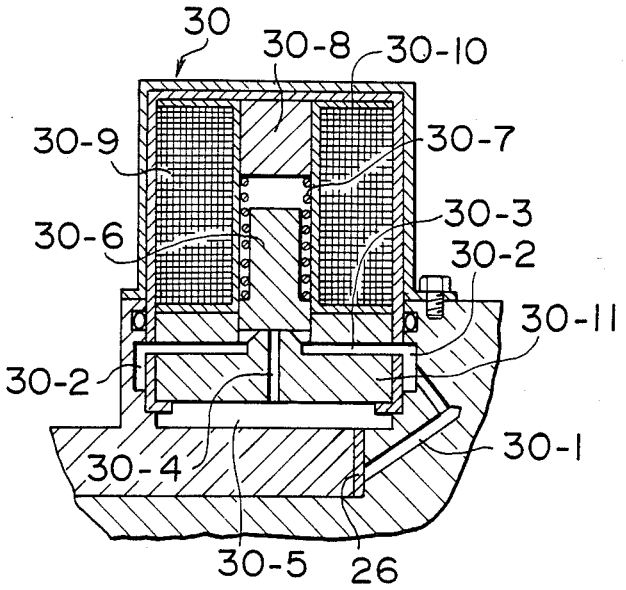
FIGS. 7 and 8 are fragmentary views of the compressor, showing a solenoid valve.
Figure 8:
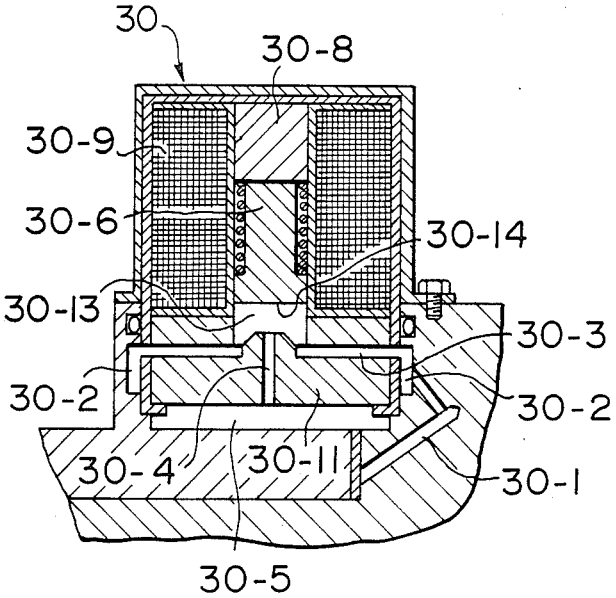

FIGS. 7 and 8 are sectional views of the solenoid valve 30 in the closed state and opened state, respectively. The solenoid valve 30 has a construction known per se and includes a stationary iron core 30-8, a movable iron core 30-6 serving as a valve member, a bobbin 30-10 surrounding the stationary and movable iron cores 30-8 and 30-6 and a coil 30-9 wound on the bobbin 30-10. A compression coil spring 30-7 is disposed between the stationary iron core 30-8 and the movable iron core 30-6 to urge both cores away from each other. A seat member 30-11 is disposed on the side of the movable iron core 30-6 opposite to the stationary iron core 30-8. A first space 30-13 is defined between the movable iron core 30-6 and the seat member 30-11 and communicated with the third small hole 30-1 through passages 30-2 and 30-3. A second space 30-5 is formed on the side of the seat member 30-11 opposite to the first space 30-13 and communicated with the suction chamber A mentioned before. The first space 30-13 and the second space 30-5 can be communicated with each other through a communication passage 30-4 which is also formed in the seat member 30-11. The communication passage 30-4, however, is adapted to be closed when the movable iron core 30-6 is in sealing engagement with the seat member 30-11. Namely, when the coil 30-9 is not energized, the movable iron core 30-6 is held in sealing engagement with the seat member 30-11 by the force of the spring 30-7 to block the communication passage 30-4 thereby interrupting the communication between the first space 30-13 and the second space 30-5, as shown in FIG. 7. However, when the coil 30-9 is energized, the movable iron core 30-6 is attracted by the stationary iron core 30-8, so that the communication passage 30-4 is opened as shown in FIG. 8. In consequence, the third small hole 30-1 is communicated with the suction chamber A through the passages 30-2 and 30-3, the first space 30-13, the communication passage 30-4 and the second space 30-5.

Figure 9:
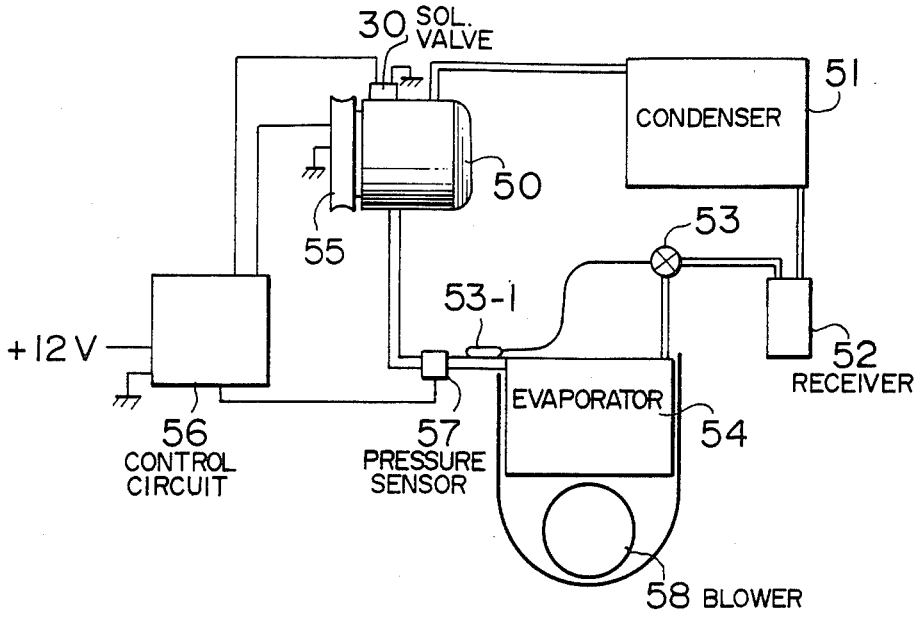
FIG. 9 diagrammatically shows a refrigeration cycle.

FIG. 9 schematically shows a refrigeration cycle which incorporates the compressor 50 described hereinbefore. The refrigeration cycle includes, in addition to the compressor 50, a condenser 51, receiver 52, thermal expansion valve 53, temperature detection bulb 53-1 and an evaporator 54. A reference numeral 57 denotes a pressure sensor adapted to detect the refrigerant pressure at the outlet side of the evaporator 54. Upon detection of a predetermined refrigerant pressure, the pressure sensor 57 delivers a pressure detection signal to a control circuit 56 which in turn produces a signal for activating the solenoid valve 30. The compressor 50 is adapted to be driven by the power of an automotive engine through an electromagnetic clutch 55. When the compressor 50 is in operation with the minimum capacity, the control circuit 56 delivers a signal for disengaging the clutch 55 if the refrigerant pressure at the evaporator outlet side is still being lowered.

The operation of the described embodiment is as follows:

When the power of the automotive engine (not shown) is transmitted to the front shaft **20*a* trough the clutch 55, the front shaft 20*a* is driven to rotate the rotor 15 within the cylinder 11-1. Consequently, the volume of each compression chamber 3 is increased and decreased cyclically. When the volume of a compression chamber 3 is being increased, the refrigerant from the evaporator 54 of the refrigeration cycle is sucked into the suction chamber A through an inlet (not shown) formed in the front housing member 22 and then into the compression chamber 3 through the suction port 2 formed in the front end plate 16. The refrigerant is then compressed in accordance with the rotation of the rotor and the refrigerant under a high pressure is discharged into the discharge chamber B through the discharge port 35. Since the discharge chamber B has an oil separation function, the lubricating oil suspended by the compressed refrigerant gas is separated therefrom and the refrigerant gas, which is now free of the lubricating oil, is delivered to the condenser 51 through the discharge port 24**.

It is necessary that, when the compressor is started, the load of the compressor has to be minimized in order to avoid any substantial impact which would otherwise be applied to the engine. The described embodiment of the compressor meets this requirement in the following manner: Namely, when the compressor is started, there is no pressure differential across the first plunger 6, so that the first plunger 6 is urged towards the first plunger chamber 7 by the force of the spring 5 to a position in which the two unloading ports 1. Similarly, the second plunger 4 is also urged by the spring 10 towards the second plunger chamber 13-1, so that the opening area of the suction port 2 is minimized as shown in FIG. 3B. At this time, the end 4-3 of the communication passage 4-6 formed in the second plunger 4 is aligned and communicated with the communication hole 12, while the other end 4-2 of the passage 4-6 is aligned with the suction port 2. Therefore, the refrigerant in the compression chamber 3 a vane has just passed the suction port 2, as shown in FIG. 1, is relieved therefrom to the suction port 2 through the communication hole 12 and the communication passage 4-6. Consequently, the pressure in the compression chamber 3 is further reduced, whereby the compressor can be started smoothly without imposing any impact on the engine.

When it is desired to increase the displacement capacity of the compressor after the compressor is started, the solenoid valve 30 is closed, as shown in FIG. 7, so that the refrigerant gas compressed in the compression chamber 3 flows through the second small hole 27, the communication passage 26-1 in the gasket 26, the first small hole 7-1 and through the fourth small hole 13-2 into the first plunger chamber 7 and the second plunger chamber 13-1. In consequence, the first plunger 6 is moved towards the plug 9-1 against the force of the spring 5 so that the bottom end of the plunger 6 progressively decreases the opening area of the unloading ports 1. Similarly, the second plunger 4 is also progressively moved overcoming the force of the spring 10 thereby progressively increasing the opening area of the suction port 2. As a result, the discharge rate of displacement capacity of the compressor is gradually increased and is maximized when the unloading ports 1 are fully closed and the suction port 2 is fully opened.

The capacity of the compressor has to be reduced when the compressor is operating at a high speed or when the refrigeration load is small. This can be achieved by opening the solenoid valve 30 as shown in FIG. 8. As the solenoid valve 30 is opened, the refrigerant gas of a high pressure introduced through the second small hole 27 into the communication passage 26-1 in the gasket 26 is relieved to the suction chamber A through the third small hole 30-1 and the solenoid valve 30. Consequently, the refrigerant of high pressure in the first and the second plunger chambers 7 and 13-1 is also discharged therefrom into the suction chamber A to allow the first and the second plungers 6 and 4 to be moved by the force of the springs 5 and 10 towards respective plunger chambers 7 and 13-1. As a result, the opening area of the unloading ports 1 is progressively increased, while the opening area of the suction port 2 is progressively decreased, thus reducing the displacement capacity of the compressor. The capacity of the compressor is minimized when the first and the second plungers 6 and 4 have reached the positions which they take at the starting of the compressor.

The electric power supplied to the solenoid valve 30 is in the form of a pulse train of voltage, and the period or time length while the solenoid valve 30 is opened is controlled by varying the duty ratio of the voltage pulse train, thereby controlling the pressure in the first plunger chamber 7 and the second plunger chamber 13-1, whereby the positions of the first and the second plungers 6 and 4 are controlled.

The solenoid valve 30, however, may be substituted by a mechanical pressure regulator 100 (FIG. 10) of the type that is disclosed in Japanese Unexamined Patent Publication No. 180098/1984.

Figure 10:
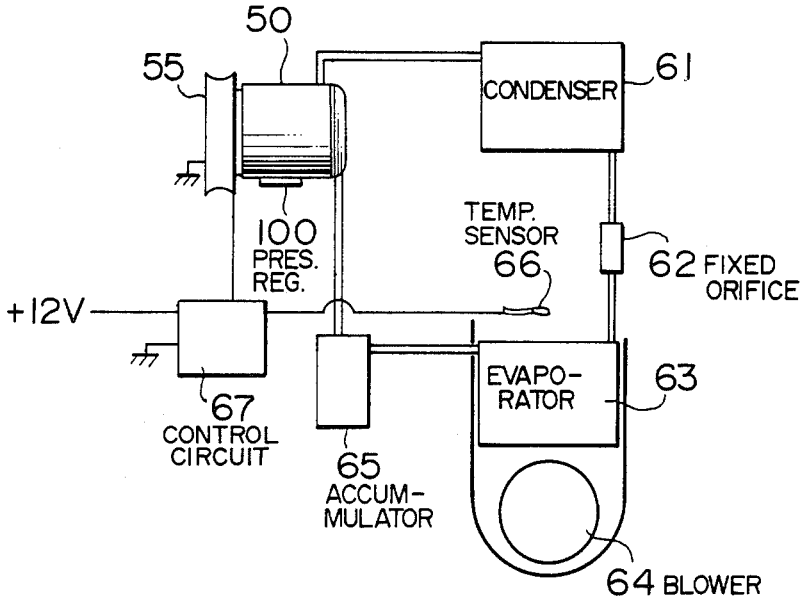
FIG. 10 diagrammatically shows another refrigeration cycle.

FIG. 10 shows another example of the refrigeration cycle in which the pressure in the first plunger chamber 7 and the second plunger chamber 13-1 is controlled by the pressure regulator 100. This example employs a condenser 61, a fixed orifice 62, an evaporator 63, a blower 64, an accumulator 65, an air outlet temperature sensor 66, and a circuit 67 for effecting an on-off control of the clutch 55. The air outlet temperature sensor 66 is adapted to measure the temperature of the air at the outlet of the evaporator 63 and delivers to the circuit 67 a signal for disengaging the clutch 55 when the air temperature has come down below a predetermined level.

The invention is not limited to the described and illustrated embodiment. For example, the vane grooves 90 are shown in FIG. 1 as being radial to the axis of the rotor 15, but this is not essential for the invention and the vane grooves and thus the vanes 19 may have their axes inclined to the radii of the rotor axis. In addition, the number of the vanes is not limited to four. It is apparent to those in the art that another number of vanes can be employed in the vane type compressor according to the invention.

What is claimed is:

1. A variable capacity vane type compressor comprising:

a housing providing a cylinder of a predetermined profile having ends closed by end walls;

a rotor disposed in said cylinder and rotatable by an external power;

said rotor being formed therein with a plurality of vane grooves;

vanes slidably received in said vane grooves and having radially outer ends disposed in slidable engagement with the inner surface of said cylinder to cooperate therewith and with said end walls to define a plurality of variable volume working chambers;

means defining a suction port so disposed as to be open to one of said working chambers when it is in its suction stroke;

an unloading mechanism including an unloading port and a first unloading passage and arranged such that said unloading port is open to one of said working chambers when it is in its compression stroke and to relieve therefrom compressed fluid through said unloading passage to a lower pressure part of the compressor;

means defining a discharge port so disposed as to be open to one of said working chambers when it is in its final stage of the compression stroke;

said unloading mechanism further including a first valve member movable to vary the opening area of said unloading port;

means for controlling the suction of fluid into the compressor and including a second passage and a second valve member movable therein to vary the opening area of said suction port;

said second passage having first and second portions communicated, respectively, with said suction port and said cylinder at a point which leads said suction port as viewed in the direction of rotation of said rotor;

said first and second valve members having pressure receiving faces, respectively, and being movable by a pressure applied to said pressure receiving faces;

means for exerting the same pressure signal to said pressure receiving faces of said first and second valve members;

said second valve member being formed therein with a third communication passage which, when said second valve member is in a position in which the opening area of said suction port is decreased most, communicates said suction port through said first and second portions of said second passage with said point of said cylinder.

2. A vane type compressor according to claim 1, wherein said unloading mechanism further includes an additional unloading port so disposed as to be opened and closed by said first valve member.

3. A vane type compressor according to claim 2, wherein said first unloading passage, first-said unloading port, said additional unloading port, said second passage, said first and second portions of said second passage and said suction port are all formed in one of said end walls.

4. A vane type compressor according to claim 1, wherein said first and second valve members comprise spools, respectively.

5. A vane type compressor according to claim 4, wherein each of said spools has an end face which forms one of said pressure receiving faces, the pressure receiving end faces of said spools cooperating with adjacent ends of said first unloading passage and second passage to define first and second variable volume spaces, and wherein said pressure exerting means include means defining a fourth passage extending between said first and second variable volume spaces and means for selectively connecting and disconnecting said fourth passage to and from one of said working chambers when in its final stage of compression stroke.

6. A vane type compressor according to claim 5, wherein said end walls of said cylinder are formed by end plates secured to the opposite ends of said cylinder, said fourth passage defining means including a gasket disposed adjacent to one of said end plates, said gasket being formed therein with an elongated slit which forms a part of said fourth passage.

7. A vane type compressor according to claim 5, wherein said selectively connecting and disconnecting means include a fourth valve member.

8. A vane type compressor according to claim 7, further including means for electromagnetically actuating said third valve member.

* * * * *